US005829604A

United States Patent [19]

Brophy

[11] Patent Number: 5,829,604

[45] Date of Patent: Nov. 3, 1998

[54] GOLF CLUB RACK

[76] Inventor: Harry F. Brophy, 753 Kendon La., Novato, Calif. 94947

[21] Appl. No.: 808,061

[22] Filed: Feb. 28, 1997

Related U.S. Application Data

[60] Provisional application No. 60/012,599, Mar. 1, 1996.

[51] Int. Cl.[6] ..... A47F 7/00

[52] U.S. Cl. ..... 211/70.2; 211/85.7

[58] Field of Search ..... 211/70.2, 60.1, 211/62, 85.7; 206/315.6, 315.2; 473/282, 287

[56] References Cited

U.S. PATENT DOCUMENTS

| | | | |
|---|---|---|---|
| 2,621,799 | 12/1952 | Wilson | 211/70.2 |
| 3,415,572 | 12/1968 | Zagwyn | 211/70.2 X |
| 3,503,518 | 3/1970 | Black | 211/70.2 |

*Primary Examiner*—Alvin C. Chin-Shue

*Assistant Examiner*—Sarah Purol

*Attorney, Agent, or Firm*—Larry D. Johnson

[57] ABSTRACT

A portable rack apparatus configured to releasably hold a plurality of golf clubs, and adapted for releasable attachment to the outside of a standard golf bag. The apparatus includes a central vertical member approximately the height of the golf bag, together with two rotatable arms fastened to the ends of the vertical member. When the arms are rotated vertically, the rack can be stored in the bag, and when the arms are rotated horizontally, the rack can be clipped and strapped to the outside of the golf bag. The bottom arm includes a plurality of sockets, each designed to loosely hold the handle or grip end of a golf club. The top arm includes a plurality of clasps or catches, each designed to securely hold the shaft of a club near the club head. When assembled on the golf bag and filled with clubs, each club can be retrieved merely by grasping the shaft near the clasp, releasing the clasp, and pulling the club out and up to clear the bottom socket. Replacement of the club in the rack is simply the reverse of this process.

4 Claims, 2 Drawing Sheets

GOLF CLUB RACK

This is a provisional application Ser. No. 60/012,599 filed Mar. 1, 1996.

BACKGROUND OF THE INVENTION

1. Field of the Invention

This invention relates generally to sporting goods and equipment, and more specifically to an improved rack apparatus for use in association with a bag of golf clubs.

2. Description of the Prior Art

When golfers use a motorized cart to move around a golf course during play, they place their golf bags on a shelf at the rear of the cart. Before almost every stroke, a golfer will shift from one golf club to another. In current practice this consists of lifting the club just used to where the handle of the club clears the rim of the bag, and then lowering the club about three feet into the bag. The golfer then selects the next club from the loose assortment of clubs, and lifts it clear of the bag.

This procedure has several drawbacks. First, each club, and the golfer's arm, have to be lifted about three feet, to a height of about four and a half feet above the ground (in fact, the club head and the golfer's arm may rise to over seven feet above the ground), then lowered an equivalent distance. Many persons, such as those with arthritic problems, seniors and short persons, find such motions painful by the end of the day. Second, short persons, finding the club heads at about eye level, have difficulty identifying the next club desired, since most clubs are marked with their number on the bottom of the club head. Third, in addition to discomfort, the above problems use extra time, which slows play on the course.

SUMMARY OF THE INVENTION

The golf club rack of this invention provides a portable rack apparatus configured to releasably hold a plurality of golf clubs, and adapted for releasable attachment to the outside of a standard golf bag. The preferred embodiment of the invention consists of a central vertical member approximately the height of the golf bag, together with two rotatable arms fastened to the ends of the vertical member. When the arms are rotated vertically (parallel to and essentially collinear with the central vertical member), the rack can be stored in the bag much in the form of an additional golf club, and when the arms are rotated horizontally, the rack can be clipped and strapped to the outside of the golf bag.

The bottom arm includes a plurality of sockets, each designed to loosely hold the handle or grip end of a golf club. The top arm includes a plurality of clasps or catches, each designed to securely hold the shaft of a club near the club head. When assembled on the golf bag and filled with clubs (e.g., one to fourteen clubs, with eight clubs in the preferred embodiment), each club will be in its designated slot, and can be retrieved merely by grasping the shaft near the clasp, releasing the clasp, and pulling the club out and up about three inches (to clear the bottom socket). Replacement of the club in the rack is simply the reverse of this process.

This arrangement provides many advantages, including but not limited to the following:

1. Eliminates the necessity for lifting each club over the golfer's head before and after use.

2. Makes club selection easier because the clubs are racked in order.

3. Time is saved in the retrieval of clubs.

4. With the preferred embodiment of a positive clasp, the clubs cannot fall out.

5. The golf bag will continue to be available for extra clubs, clothing, balls, etc.

6. In the stored configuration, the rack can be stored in the bag with no increase in overall dimensions.

The unique elements of the preferred embodiment can be utilized in various other configurations.

1. The horizontal bars (arms) can be curved or hinged, to conform to the shape of the golf bag.

2. The golf bag can be designed with a slit full length, which closes with a door, or hinging in clam-shell fashion, and the clasps can be secured to the interior of the bag. While helpful, handle sockets would not necessarily be needed.

3. The horizontal bars (arms) could be secured to the golf bag directly, without a vertical member. The horizontal bars would preferably be rapidly removable from the bag for storage.

4. The horizontal bars (arms) could be configured such that the clasps are pivotable over the rim of the bag, to the inside.

Thus, the inventive apparatus provides a catch or clasp to secure the shaft of a golf club near the club head, where the clasp is near the rim of the golf bag, together with means to restrain the handle from motions that would compromise the security of the club. The components are attached to the golf bag in such a way that the golf club can be removed and replaced without significant vertical movement.

DETAILED DESCRIPTION OF A PREFERRED EMBODIMENT

Figure 1:
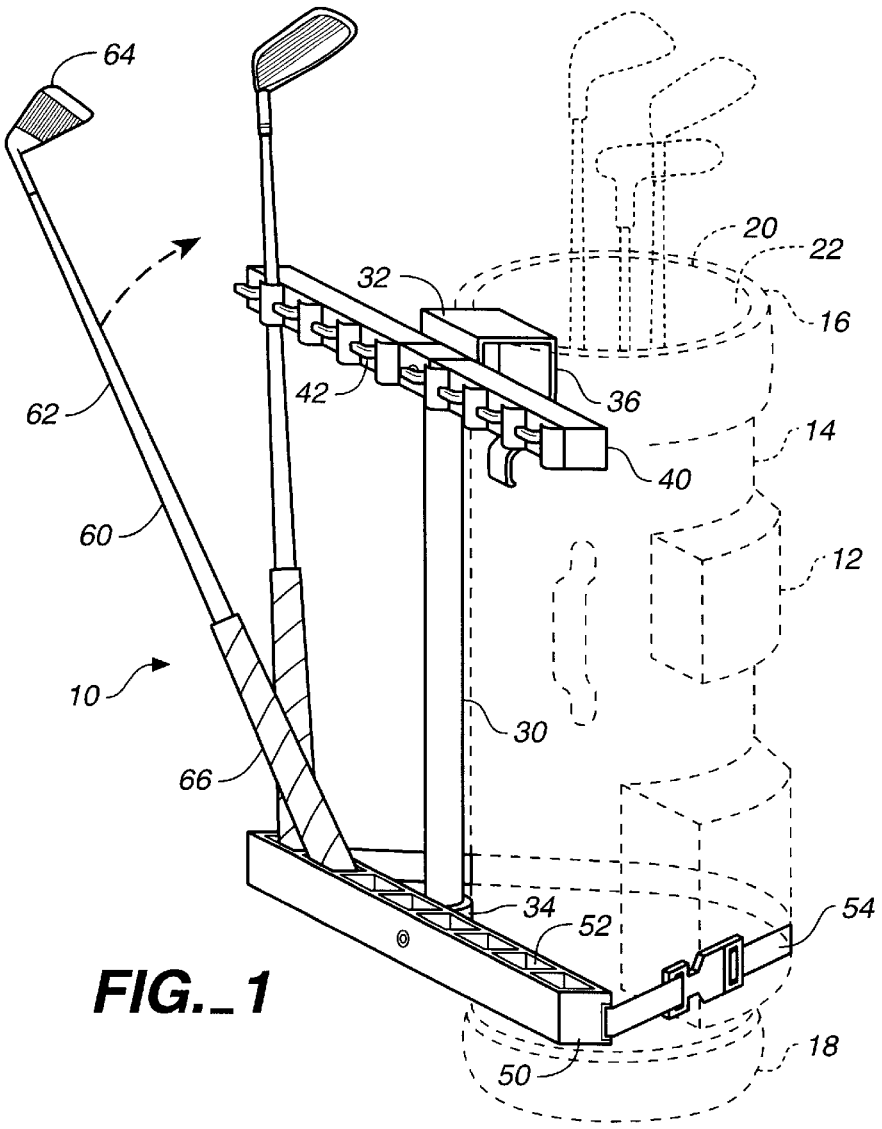
FIG. 1 is a perspective view of a golf club rack apparatus of this invention as installed on a typical golf bag (illustrated in phantom lines), illustrating a typical golf club being inserted into the rack apparatus.

FIG. 1 is a perspective view of the golf club rack apparatus 10 of this invention as installed on a typical golf bag 12 (illustrated in phantom lines). Golf bag 12 includes a body portion 14 having a top 16 and bottom 18 with a rim 20 at the top defining an opening to an internal cavity 22, into which golf clubs may be placed and held in the normal manner. Apparatus 10 includes a central vertical member 30 having a first end 32 and second end 34. First end 32 includes a bracket or hook portion 36 adapted to releasably attach to rim 20 of golf bag 12. Upper arm portion 40 is pivotally connected to central vertical member 30 proximate first end 32, and bears a plurality of clasp sections 42 disposed along its length. Lower arm portion 50 is similarly pivotally connected to central vertical member 30, but proximate second end 34. Lower arm portion 50 includes a plurality of sockets 52 disposed along its length, which are complementary and collinear with corresponding clasp sections 42 on upper arm portion 40. Lower arm portion 50 also includes a strap 54 or other article to encircle golf bag 12 proximate its bottom 18. This strap may fasten on itself with the use of hook and loop fastener or other mechanism. Alternatively, this strap may affix directly to the central vertical member proximate second end 34.

A golf club 60 having a shaft 62, head 64 and handle or grip 66, may be placed into the apparatus 10 by insertion of handle 66 into one of the sockets 52 on lower arm portion 50, and placement of shaft 62 into the corresponding one of clasp sections 42 on upper arm portion 40. One or a plurality of golf clubs can be held in the apparatus in this manner.

Figure 2:
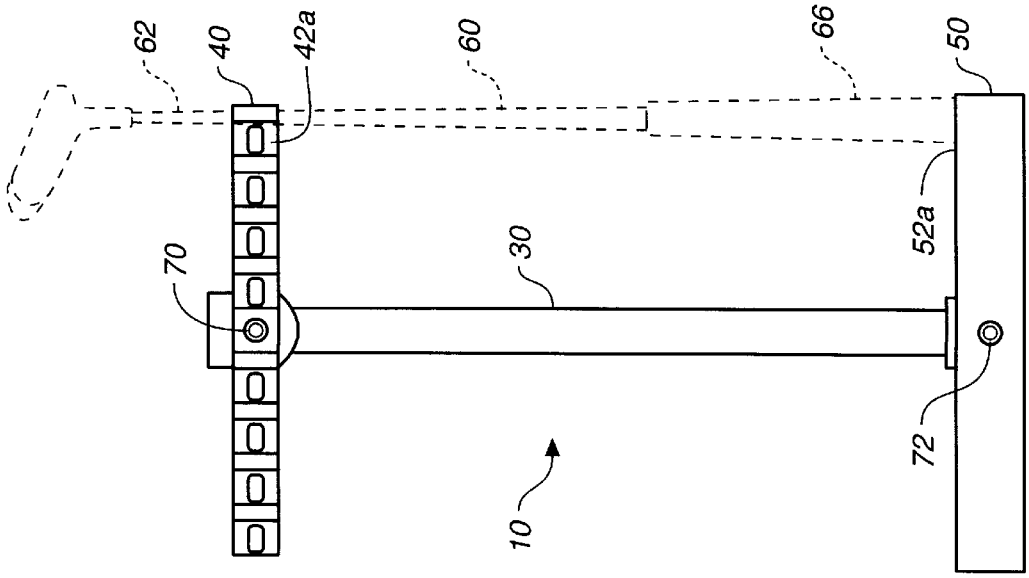
FIG. 2 is a front elevation view of the golf club rack apparatus of FIG. 1.

FIG. 2 is a front elevation view of the golf club rack apparatus 10 of FIG. 1. This view illustrates that upper arm portion 40 may have an axis 70 upon which it may rotate relative to central vertical member 30, while lower arm portion 50 may have an axis 72 upon which it may rotate relative to central vertical member 30. This view also illustrates a golf club 60 essentially vertically aligned with it's handle 66 in a given socket 52*a* in lower arm portion 50, and shaft 62 inserted into corresponding clasp section 42*a* of upper arm portion 40. The sockets in lower arm portion 50 are preferably of nominal depth, e.g., three inches, so that the golf club handles will be prevented from inadvertent removal, as by bouncing during transit over a golf course.

Figure 3:
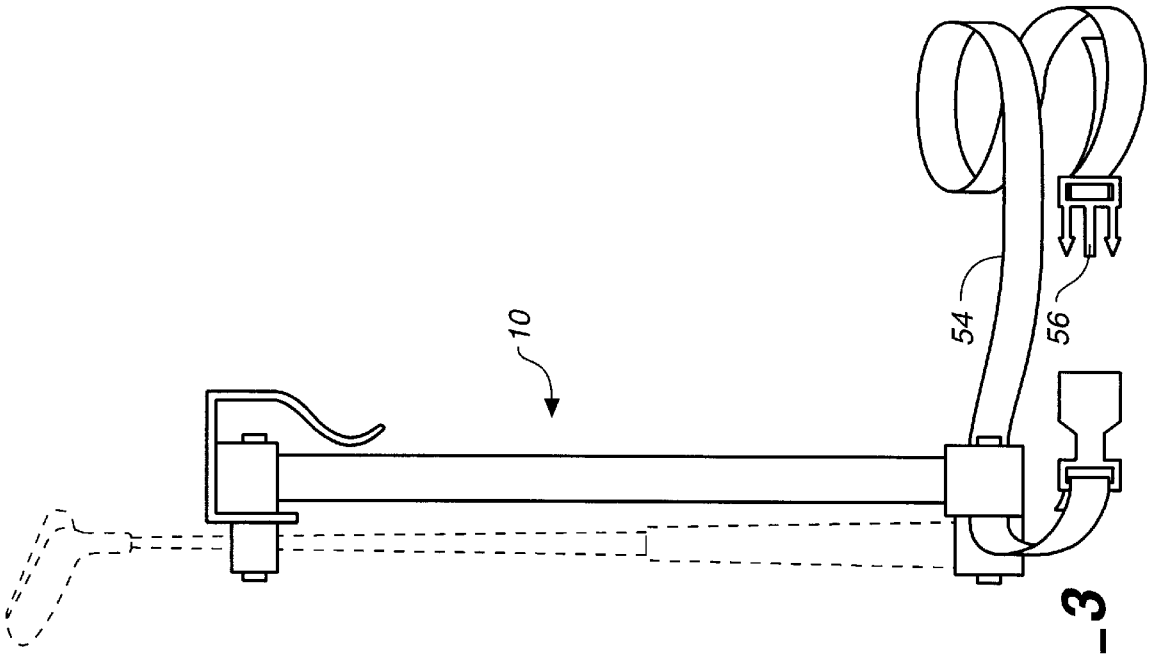
FIG. 3 is a side elevation view of the golf club rack apparatus of FIG. 1, illustrating an alternate lower arm strap arrangement.

FIG. 3 is a side elevation view of the golf club rack apparatus 10 of FIG. 1, illustrating an alternate lower arm strap 54 arrangement, as by having a releasable buckle-type fastener 56.

Figure 4:
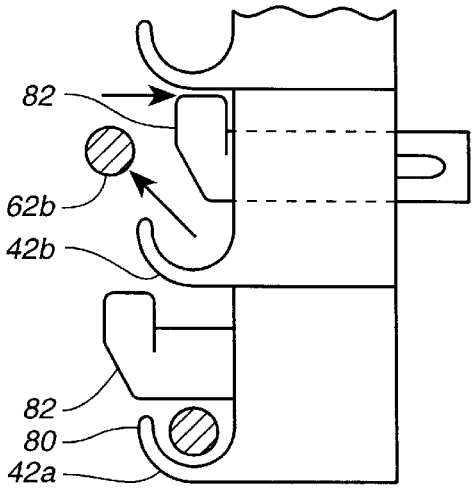
FIG. 4 is a top plan view of a portion of the upper arm portion of the golf club rack apparatus of this invention, illustrating a club shaft being released from its clasp section, and another club still captured by its clasp section.

FIG. 4 is a top plan view of a portion of the upper arm portion 40 of the golf club rack apparatus of this invention. Upper arm portion 40 includes a plurality of clasp sections 42*a,* 42*b,* etc. Each clasp section may include a semi-circular finger portion 80, and a moveable latch portion 82. In the preferred embodiment, latch portion 82 is spring loaded such that it may be manually depressed by the golf club shaft (or the user's hand) to permit access to the semi-circular finger for insertion of the club shaft. Thus, in FIG. 4, golf club shaft 62*b* can be removed from clasp section 42*b* by depressing latch 82.

Figure 5:
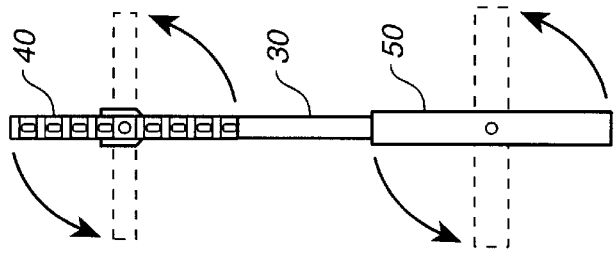
FIG. 5 is a front elevation view of the golf club rack apparatus of this invention with its upper and lower arm portions being pivoted from the use position to the storage position.

FIG. 5 is a front elevation view of the golf club rack apparatus 10 with its upper arm portion 40 and lower arm portion 50 having been pivoted from the use position to the storage position parallel to and essentially collinear with central vertical member 30. Upper and lower arm portions 40, 50 preferably include locks, detents, or other mechanisms to maintain them in the use and/or storage positions until forcibly shifted to the other position by the user.

While this invention has been described in connection with preferred embodiments thereof, it is obvious that modifications and changes therein may be made by those skilled in the art to which it pertains without departing from the spirit and scope of the invention. For example, the device may be used with pull carts, motorized carts, or the like. Accordingly, the scope of this invention is to be limited only by the appended claims and equivalents.

What is claimed as invention is:

1. A golf club rack apparatus for removable installation on a golf bag having a body portion, a top and a bottom with a rim at the top defining an opening to an internal cavity into which golf clubs may be placed, said apparatus comprising:

a central vertical member having a first end and a second end, said first end including a hook portion adapted to releasably attach to the golf bag rim;

an upper arm portion pivotally connected to said central vertical member proximate said first end, said upper arm portion bearing a plurality of clasp sections;

a lower arm portion pivotally connected to said central vertical member proximate said second end, said lower arm portion including a plurality of sockets; wherein a golf club having a handle and a shaft may be placed into said apparatus by insertion of its handle into one of said sockets on said lower arm portion, and placement of its shaft into one of said clasp sections on said upper arm portion.

2. The golf club rack apparatus of claim 1 wherein said upper arm portion is pivotable to be parallel with said central vertical member.

3. The golf club rack apparatus of claim 1 wherein said lower arm portion is pivotable to be parallel with said central vertical member.

4. The golf club rack apparatus of claim 1 wherein said upper arm portion includes a plurality of clasp sections each including a semi-circular finger portion and a moveable latch portion.

* * * * *